US010276982B2

(12) United States Patent
Feng et al.

(10) Patent No.: US 10,276,982 B2
(45) Date of Patent: Apr. 30, 2019

(54) ELECTRICAL CONNECTOR

(71) Applicant: LOTES CO., LTD, Keelung (TW)

(72) Inventors: Xiao Feng, Keelung (TW); Bo Zeng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/831,767

(22) Filed: Dec. 5, 2017

(65) Prior Publication Data

US 2018/0166830 A1 Jun. 14, 2018

(30) Foreign Application Priority Data

Dec. 9, 2016 (CN) ..... 2016 2 1349436 U

(51) Int. Cl.

| | |
|---|---|
| ***H01R 13/6581*** | (2011.01) |
| ***H01R 24/64*** | (2011.01) |
| ***H01R 13/6596*** | (2011.01) |
| ***H01R 13/6597*** | (2011.01) |
| ***H01R 13/502*** | (2006.01) |

(Continued)

(52) U.S. Cl.

CPC ..... *H01R 13/6581* (2013.01); *H01R 13/502* (2013.01); *H01R 13/6593* (2013.01); *H01R 13/6596* (2013.01); *H01R 13/6597* (2013.01); *H01R 24/60* (2013.01); *H01R 24/64* (2013.01); *H01R 12/716* (2013.01); *H01R 13/506* (2013.01); *H01R 13/6594* (2013.01); *H01R 2107/00* (2013.01)

(58) Field of Classification Search

CPC ..... H01R 13/6581; H01R 13/6585; H01R 13/6591; H01R 13/506; H01R 13/502; H01R 13/40; H01R 13/6594; H01R 13/5202; H01R 12/716; H01R 13/6597; H01R 13/6596; H01R 24/64

See application file for complete search history.

(56) References Cited

U.S. PATENT DOCUMENTS

| | | | | |
|---|---|---|---|---|
| 9,647,377 | B1 * | 5/2017 | Peng | H01R 13/405 |
| 2016/0285209 | A1 * | 9/2016 | Peng | H01R 13/6585 |

(Continued)

FOREIGN PATENT DOCUMENTS

| | | |
|---|---|---|
| CN | 204243282 U | 4/2015 |
| CN | 204271328 U | 4/2015 |

(Continued)

*Primary Examiner* — Jean F Duverne

(74) *Attorney, Agent, or Firm* — Locke Lord LLP; Tim Tingkang Xia, Esq.

(57) ABSTRACT

An electrical connector includes an insulating body, multiple terminals, a shielding sheet, a metal member, and a metal shell. The insulating body includes a base and a tongue extending forward from the base. The rear end of the tongue is provided with a step portion. The terminals are fixed in the base, exposed to the upper and lower surfaces of the tongue, and arranged in an upper row and a lower row. The shielding sheet is disposed in the tongue and located between the upper and lower rows of terminals. The metal member is fixed on the step portion, and has a first section located on the step portion and a second section located on the base. The second section extends forward to form an elastic piece. The metal shell wraps a periphery of the insulating body and the metal member. The elastic piece urges against the metal shell.

21 Claims, 9 Drawing Sheets

(51) Int. Cl.

| | |
|---|---|
| ***H01R 24/60*** | (2011.01) |
| ***H01R 13/6593*** | (2011.01) |
| *H01R 12/71* | (2011.01) |
| *H01R 107/00* | (2006.01) |
| *H01R 13/6594* | (2011.01) |
| *H01R 13/506* | (2006.01) |

(56) References Cited

U.S. PATENT DOCUMENTS

| | | | | |
|---|---|---|---|---|
| 2017/0040721 | A1* | 2/2017 | Tsai | H01R 13/502 |
| 2017/0264054 | A1* | 9/2017 | Zhao | H01R 13/5202 |

FOREIGN PATENT DOCUMENTS

| | | | |
|---|---|---|---|
| CN | 204424577 | U | 6/2015 |
| CN | 204481256 | U | 7/2015 |
| CN | 204947248 | U | 1/2016 |
| CN | 204966754 | U | 1/2016 |
| CN | 105406254 | A | 3/2016 |
| CN | 205092350 | U | 3/2016 |
| CN | 105977666 | A | 9/2016 |
| TW | M517437 | U | 2/2016 |

* cited by examiner

100

ELECTRICAL CONNECTOR

CROSS-REFERENCE TO RELATED APPLICATIONS

This non-provisional application claims priority to and benefit of, under 35 U.S.C. § 119(a), Patent Application No. 201621349436.2 filed in P.R. China on Dec. 9, 2016, the entire content of which is hereby incorporated by reference.

FIELD OF THE INVENTION

The present invention relates to an electrical connector, and in particular to an electrical connector with good high frequency transmission performance.

BACKGROUND OF THE INVENTION

A universal serial bus (USB) electrical connector of an existing TYPE C specification usually includes an insulating body, multiple terminals, a metal member, and a metal shell. The insulating body includes a base and a tongue extending forward from the base. The terminals are received in the insulating body. The terminals include differential signal terminals for transmitting high frequency signals and ground terminals. The terminals are used for being soldered to a circuit board. The metal member is mounted and fixed on the tongue and is located at the outer side of the terminals. A metal shell is sheathed outside the insulating body and the metal member. The metal shell is used for being soldered to the circuit board. The metal member is used for shielding a noise signal around the terminals. The metal member extends backward to form an elastic piece to urge against the metal shell, thus achieving communication of the metal member and the metal shell. However, when the metal shell is assembled, the elastic piece and the wall surface of the metal shell undergo stress interference, and an arm of force of the elastic piece pulls the metal member, such that the metal member is stressed to release, the metal member cannot well shield the terminals, and therefore the electrical connector cannot obtain good high frequency transmission performance.

Therefore, a heretofore unaddressed need exists in the art to address the aforementioned deficiencies and inadequacies.

SUMMARY OF THE INVENTION

In one aspect, the present invention relates to an electrical connector with good high frequency transmission performance.

In certain embodiments, an electrical connector includes an insulating body, multiple terminals, a shielding sheet, a metal member and a metal shell. The insulating body includes a base and a tongue extending forward from the base. The rear end of the tongue is provided with a step portion. The terminals are fixed in the base, exposed to the upper and lower surfaces of the tongue, and arranged in an upper row and a lower row. The shielding sheet is disposed in the tongue and located between the upper and lower rows of terminals. The metal member is fixed on the step portion. The metal member has a first section located on the step portion and a second section located on the base, and the second section extends forward to form an elastic piece. The metal shell wraps a periphery of the insulating body and the metal member, and the elastic piece urging against the metal shell.

In certain embodiments, the second section includes a vertical section connected with the first section, a horizontal section extending backward from the vertical section, and a first rear cover formed by bending and extending upward from the horizontal section. The first rear cover covers the rear end surface of the base.

In certain embodiments, the elastic piece firstly bends and extends forward from the lower end of the first rear cover to form a first bending portion, and then bends and extends upward to form a second bending portion, the elastic piece has a contacting portion urging against the metal shell, and the contacting portion is located on the second bending portion.

In certain embodiments, the bottom surface of the base extends downward to form a protruding block, the front end surface of the protruding block is provided with a first slope, and the bottom surface of the protruding block is higher than the contacting portion.

In certain embodiments, the bottom surface of the protruding block is lower than the horizontal section.

In certain embodiments, the bottom surface of the base is recessed upward to form a first groove, the elastic piece is accommodated in the first groove, and a clearance is provided between the free tail end of the elastic piece and the top surface of the first groove.

In certain embodiments, the terminals at two outermost sides of the terminals in the upper row are two ground terminals. Each ground terminal is provided with a soldering portion, a soldering pin extends from the rear end of the metal member, the soldering pin is adjacent to the soldering portion of each ground terminal, and the soldering pin and each ground terminal are soldered on the same soldering pad on a circuit board.

In certain embodiments, the rear end of the second section bends and extends downward to form a second rear cover, the second rear cover covers the rear end surface of the base, and the soldering pin is formed by extending downward from the lower end of the second rear cover.

In another aspect, the present invention relates to an electrical connector. In certain embodiments, an electrical connector includes an insulating body, multiple terminals, a metal member and a metal shell. The insulating body includes a base and a tongue extending forward from the base. The terminals are fixed in the base and exposed to the surface of the tongue. The metal member is fixed on the tongue. The metal member has a first section located on the tongue and a second section located on the base, and the second section extending forward to form an elastic piece. The metal shell wraps a periphery of the insulating body and the metal member, and the elastic piece urging against the metal shell.

In certain embodiments, the second section includes a vertical section connected with the first section, a horizontal section formed by extending backward from the vertical section, and a first rear cover formed by bending and extending upward from the horizontal section. The first rear cover covers the rear end surface of the base.

In certain embodiments, the bottom surface of the base is recessed upward to form a second groove, the front end surface of the base is recessed backward to form a third groove, the horizontal section is clamped in the second groove, the vertical section is clamped in the third groove, the second groove is communicated with the third groove, and a second slope is provided at a joint the second groove and the third groove on the base.

In certain embodiments, the elastic piece firstly bends and extends forward from the lower end of the first rear cover to form a first bending portion, and then bends and extends upward to form a second bending portion. The elastic piece has a contacting portion urging against the metal shell, and the contacting portion is located on the second bending portion.

In certain embodiments, the bottom surface of the base extends downward to form a protruding block, and the bottom surface of the protruding block is higher than the contacting portion.

In certain embodiments, the bottom surface of the protruding block is lower than the horizontal section.

In certain embodiments, the bottom surface of the base is recessed upward to form a first groove, the elastic piece is accommodated in the first groove, and a clearance is provided between the free tail end of the elastic piece and the top surface of the first groove.

In certain embodiments, the second section is recessed to form at least one closed-loop-shaped through hole, the through hole running through the upper and lower surfaces of the second section.

In certain embodiments, the metal shell includes a top wall, a bottom wall and two side walls connecting the top wall and the bottom wall, and the elastic piece urges against the bottom wall.

In certain embodiments, the terminals include at least one ground terminal, the ground terminal is provided with a soldering portion, a soldering pin extends from the rear end of the metal member, the soldering pin is adjacent to the soldering portion of the ground terminal, and the soldering pin and the ground terminal are soldered on the same soldering pad on a circuit board.

In certain embodiments, the rear end of the second section bends and extends downward to form a second rear cover, the second rear cover covers the rear end surface of the base, and the soldering pin is formed by extending downward from the lower end of the second rear cover.

Compared with the related art, certain embodiments of the present invention have the following beneficial advantages: the metal member located on the base extends forward to form the elastic piece urging against the metal shell; and when the metal shell is assembled, an arm of force of the elastic piece is not on the first section, located on the tongue, of the metal member, the elastic piece and the bottom wall of the metal shell undergo stress interference so as not to pull the first section, and therefore the metal member can be prevented from being released. The metal member is provided with the rear cover covering the rear end surface of the base, so it is unnecessary to additionally provide a rear cover on the metal shell. Moreover, a soldering pin extends from the rear cover, the soldering pin and the upper ground terminal are soldered on the same soldering pad of the circuit board, thus simplifying the design of the circuit board, and enhancing the shielding effect of the electrical connector. Moreover, the metal member is grounded by means of the soldering pin, such that the metal member can be stably grounded, a good shielding protection effect on signal transmission of the multiple terminals can be achieved accordingly, and resonance is reduced, such that the electrical connector has good high frequency transmission performance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
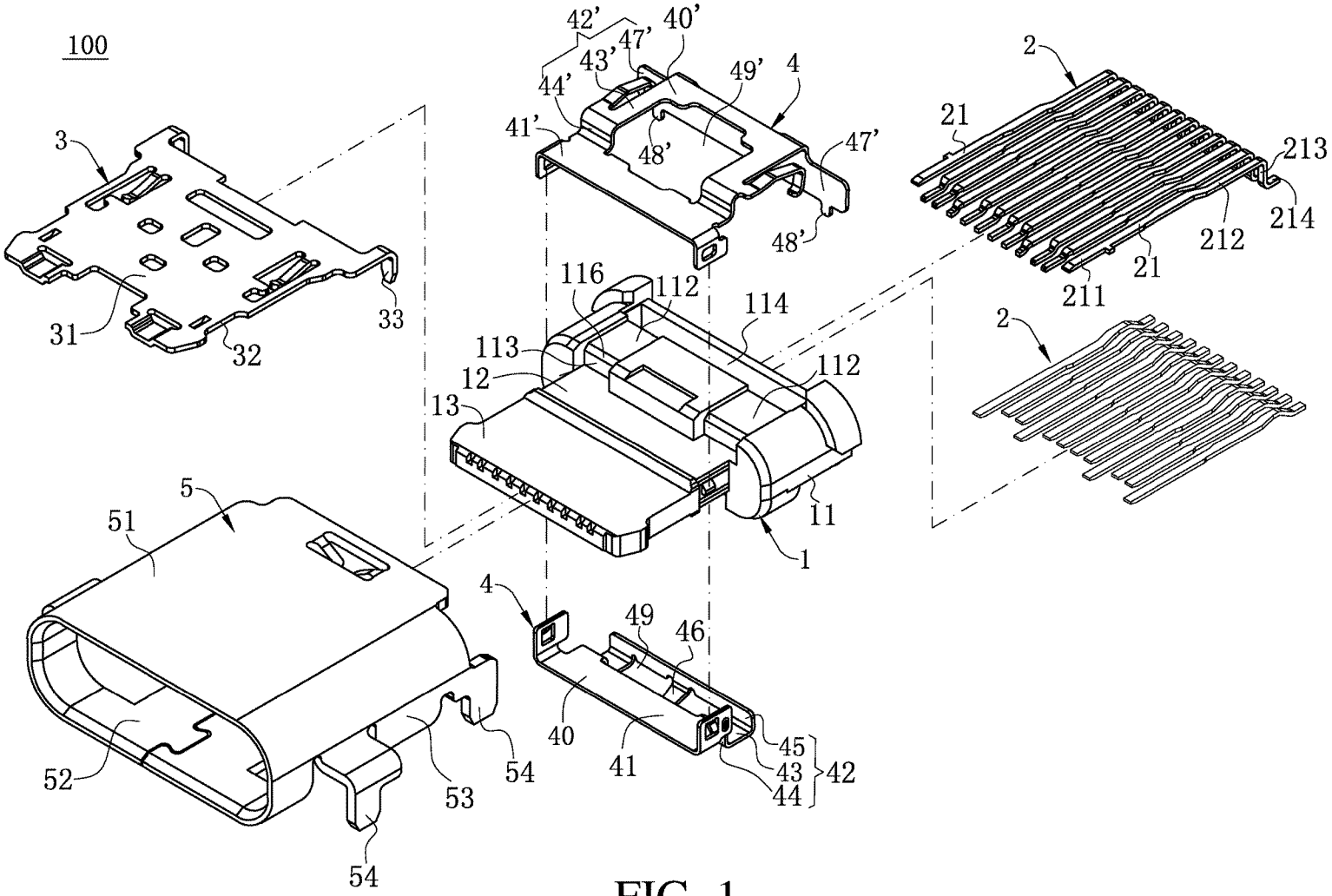
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 5:
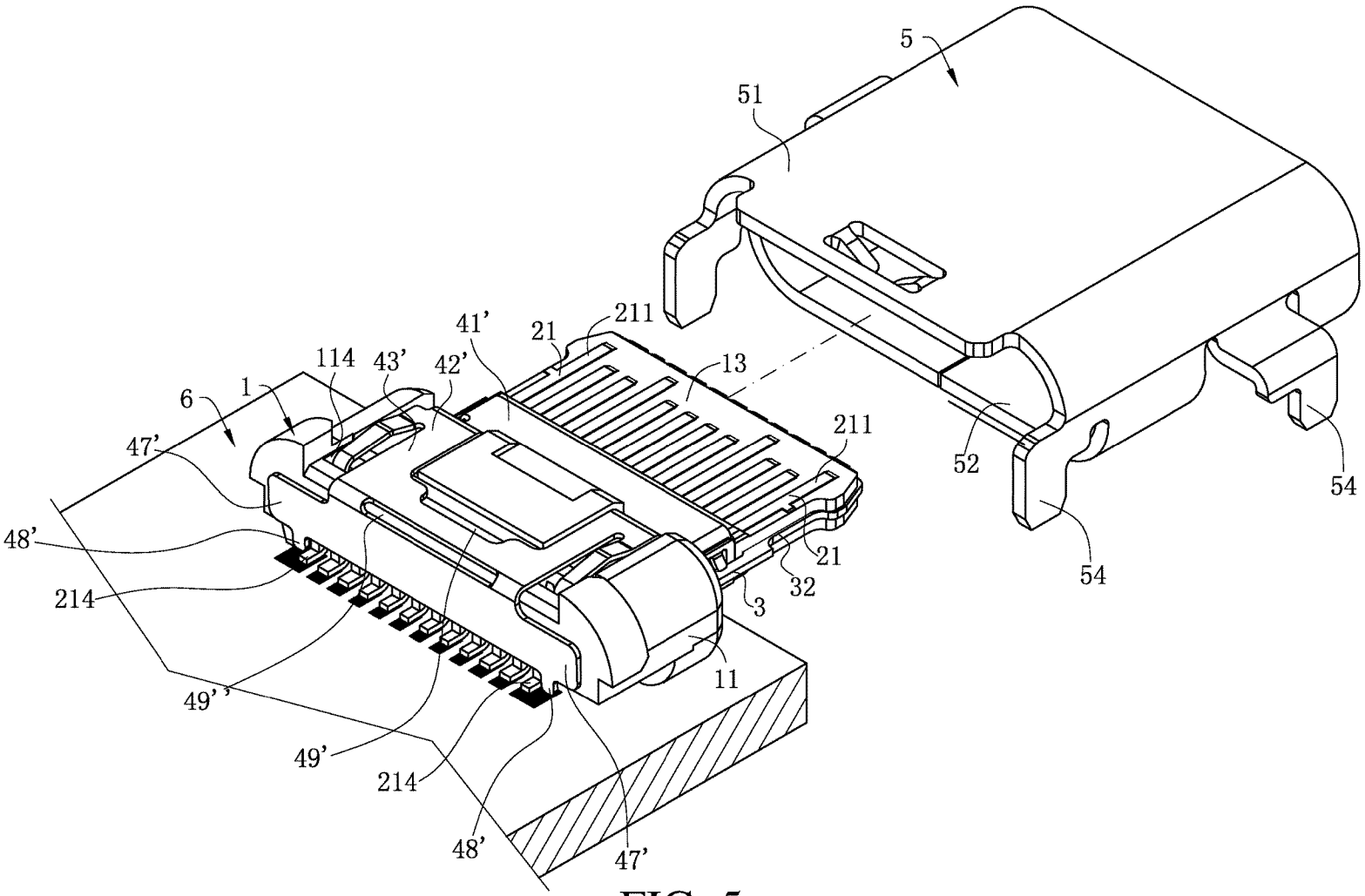
FIG. 5 is a partial three-dimensional explosive view when an electrical connector according to one embodiment of the present invention is assembled on a circuit board.
Figure 6:
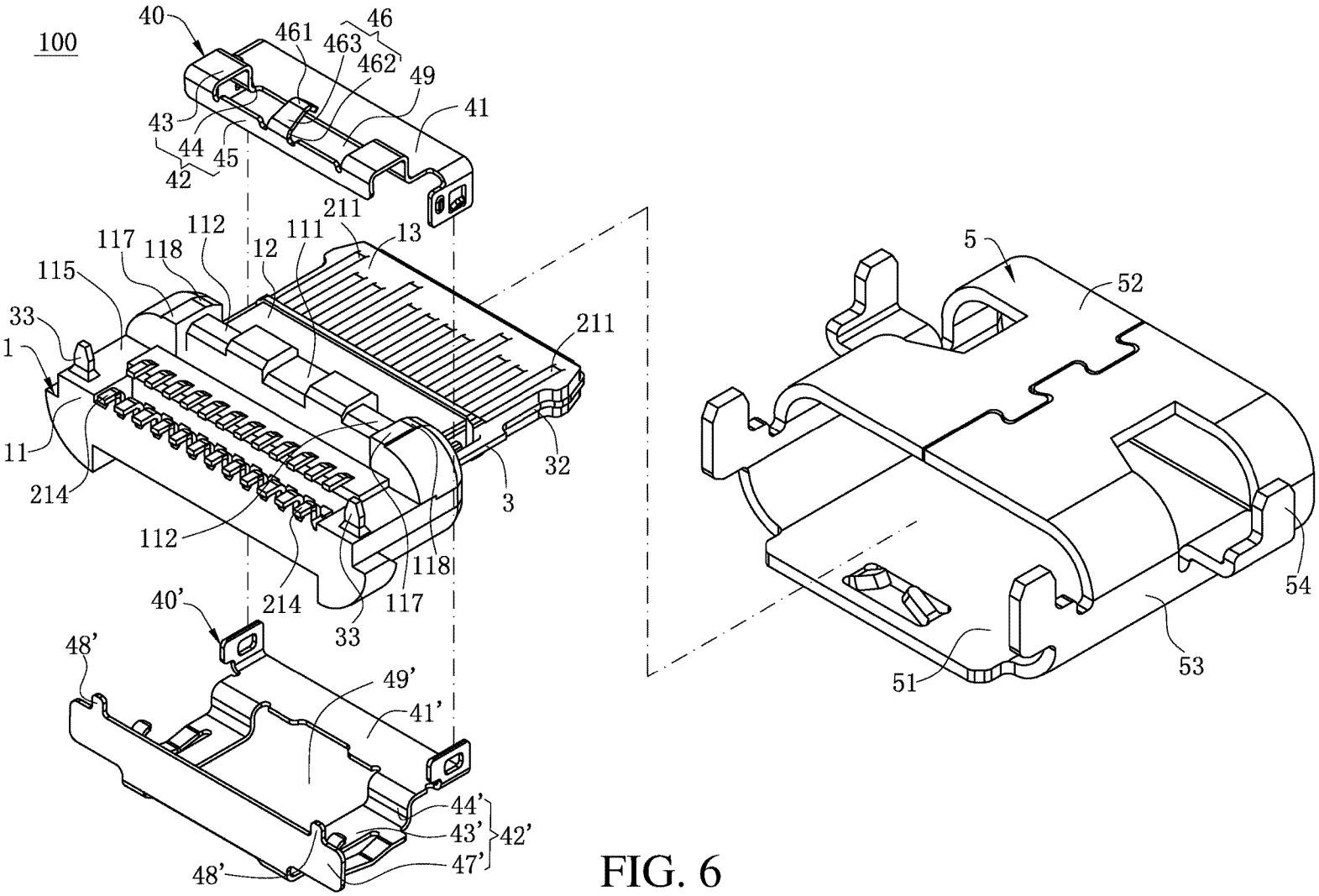
FIG. 6 is a partial three-dimensional exploded view of FIG. 4 from another angle.
Figure 7:
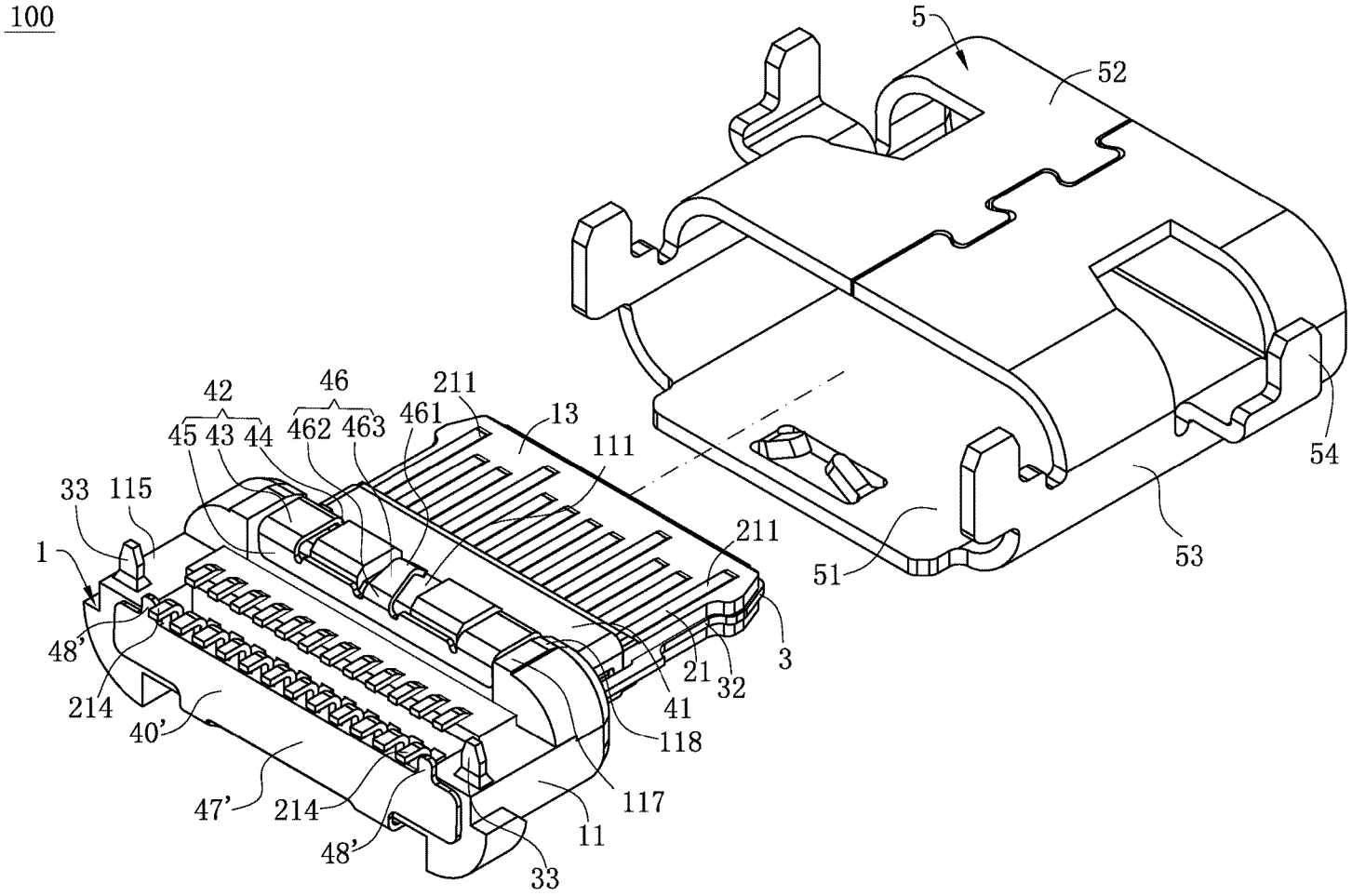
FIG. 7 is a partial three-dimensional exploded view of FIG. 3 from another angle.
Figure 8:
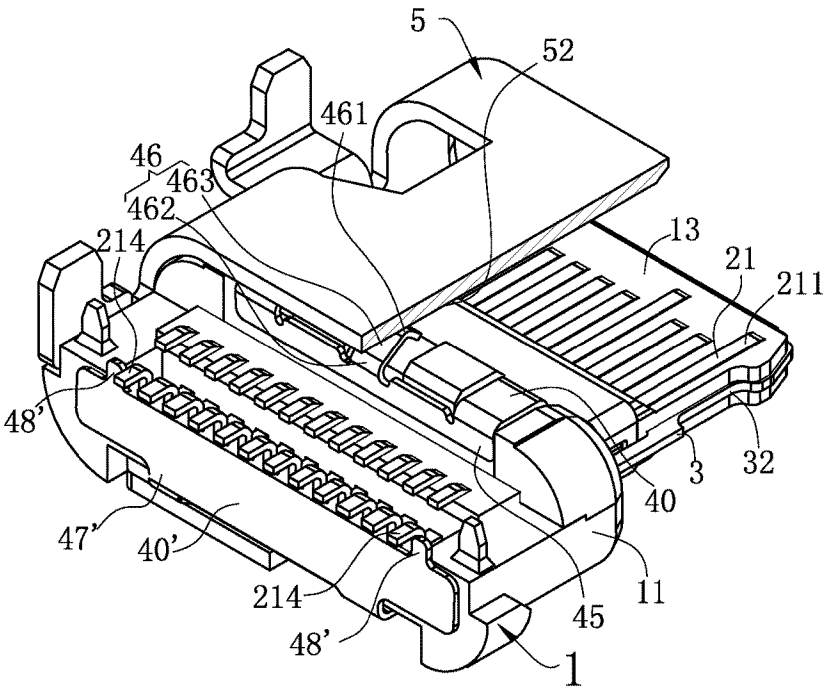
FIG. 8 is a partial sectional view of an electrical connector according to one embodiment of the present invention.
Figure 9:
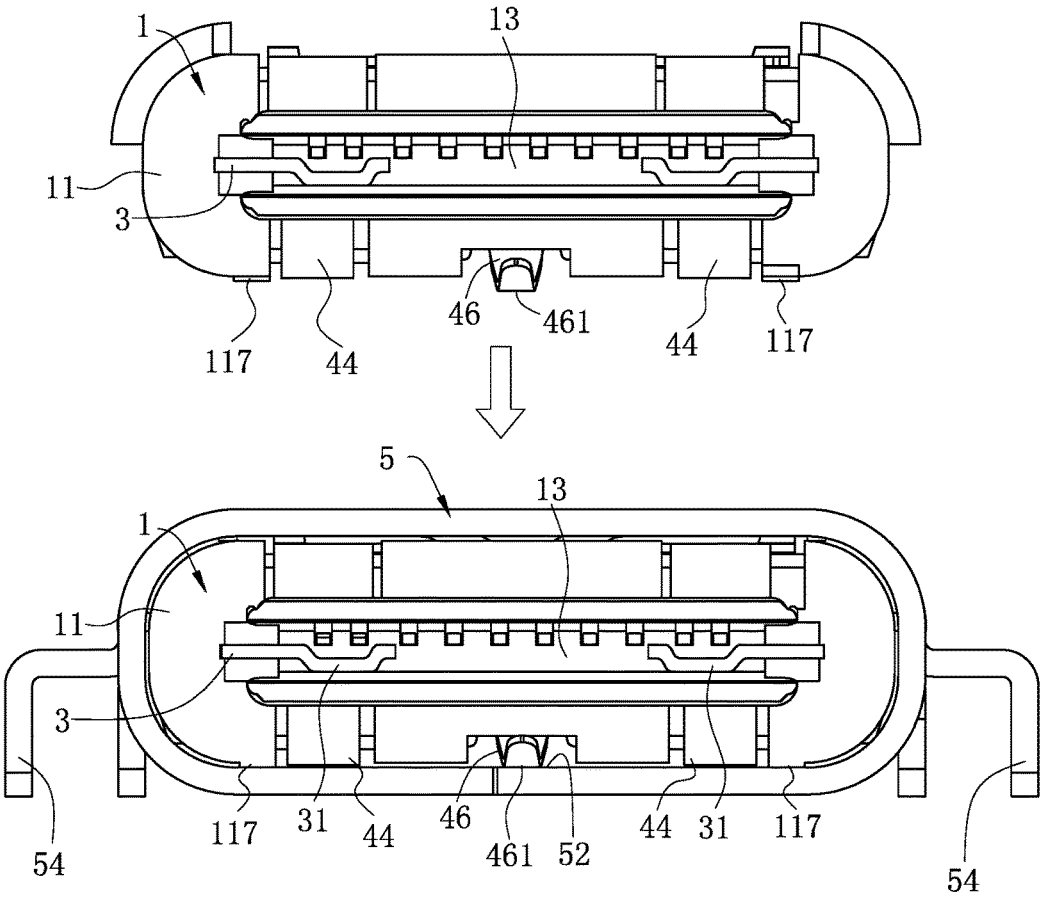
FIG. 9 is a plane view of an electrical connector according to one embodiment of the present invention.

As shown in FIGS. 1 and 5, in certain embodiments, an electrical connector 100 of the present invention is used for being mounted on a circuit board 6. The electrical connector 100 includes an insulating body 1, multiple terminals 2 received in the insulating body 1 and arranged in an upper row and a lower row on the insulating body 1, a shielding sheet 3 disposed in the insulating body 1 and located between the upper and lower rows of terminals 2, a metal member 4 fixed on the insulating body 1, and a metal shell 5 framed at the outer side of the insulating body 1.

The metal shell 5 encloses to form a mating cavity in 180-degree symmetric arrangement to wrap the insulating body 1. The metal shell 5 has multiple ground soldering pins 54 correspondingly soldered on the circuit board 6. The metal shell 5 includes a top wall 51, a bottom wall 52 and two side walls 53 connecting the top wall 51 and the bottom wall 52.

Figure 3:
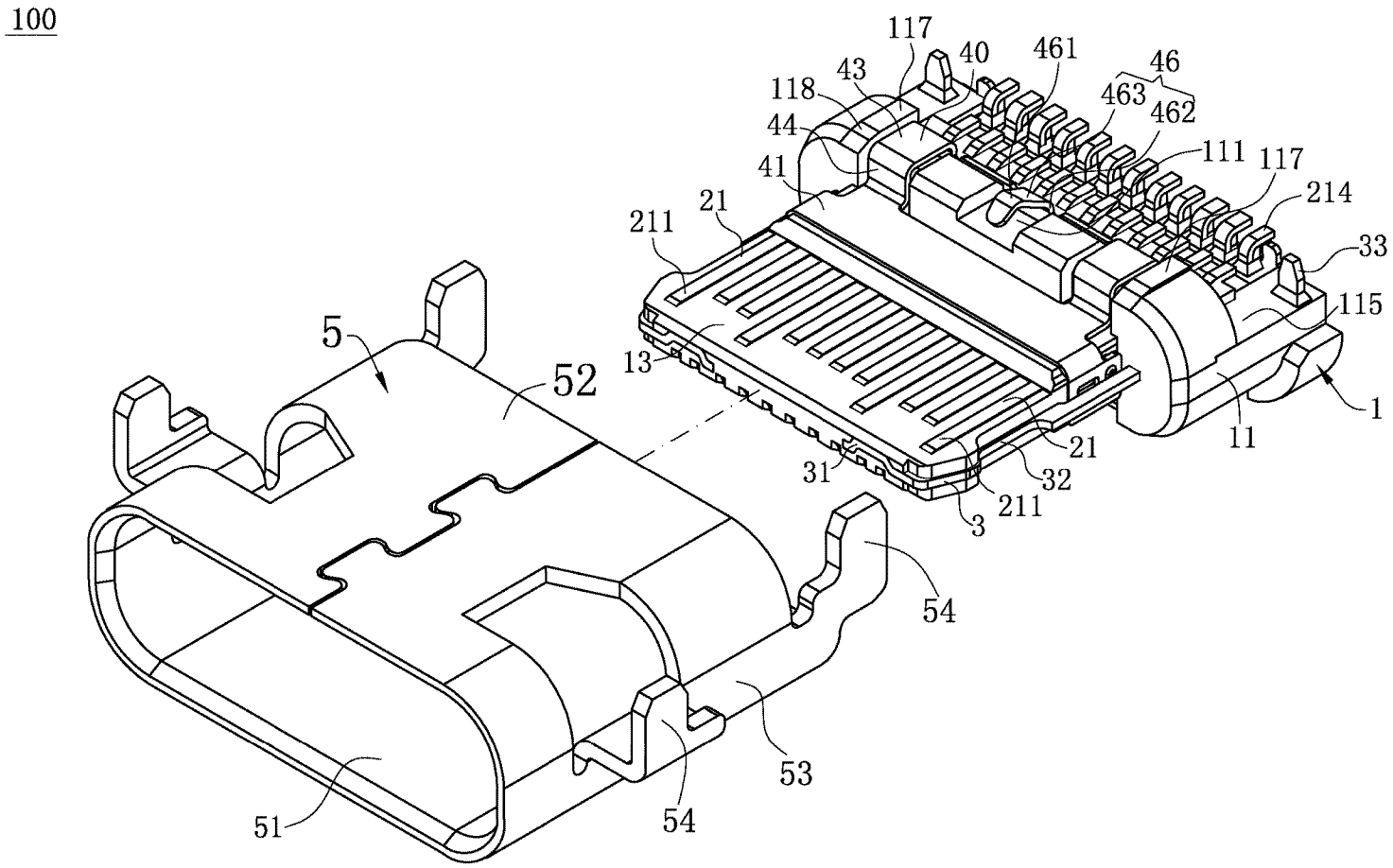
FIG. 3 is a partial three-dimensional exploded view of FIG. 2 from another angle.

As shown in FIGS. 1 and 3, the insulating body 1 includes a base 11 and a tongue 13 extending forward from the base 11. The base 11 is relatively wide and large, while the tongue 13 is relatively narrow and long. The rear end of the tongue 13 is provided with a step portion 12. The two sides of the top surface and the bottom surface of the base 11 are recessed downward and upward respectively to form four second grooves 112. The two sides of the front end surface of the base 11 are recessed backward to form four third grooves 113, the four second grooves 112 are communicated with the four third grooves 113 respectively, and a second slope 116 is provided at the joint of each second groove 112 and the corresponding third grooves 113 on the base 11. The middle of the bottom surface of the base 11 is recessed downward to form a first groove 111. The second grooves 112 and the first groove 111 run through the front end surface and the rear end surface of the base 11. The two sides of the bottom surface of the base 11 extend downward to form two protruding blocks 117, and a first slope 118 is provided on the front end surface of each protruding block 117 for guiding insertion of a mating connector (not shown). The rear side of the top surface of the base 11 is recessed downward to form a fourth groove 114. The rear end of the bottom surface of the base 11 is provided with an escaping slot 115.

Figure 2:
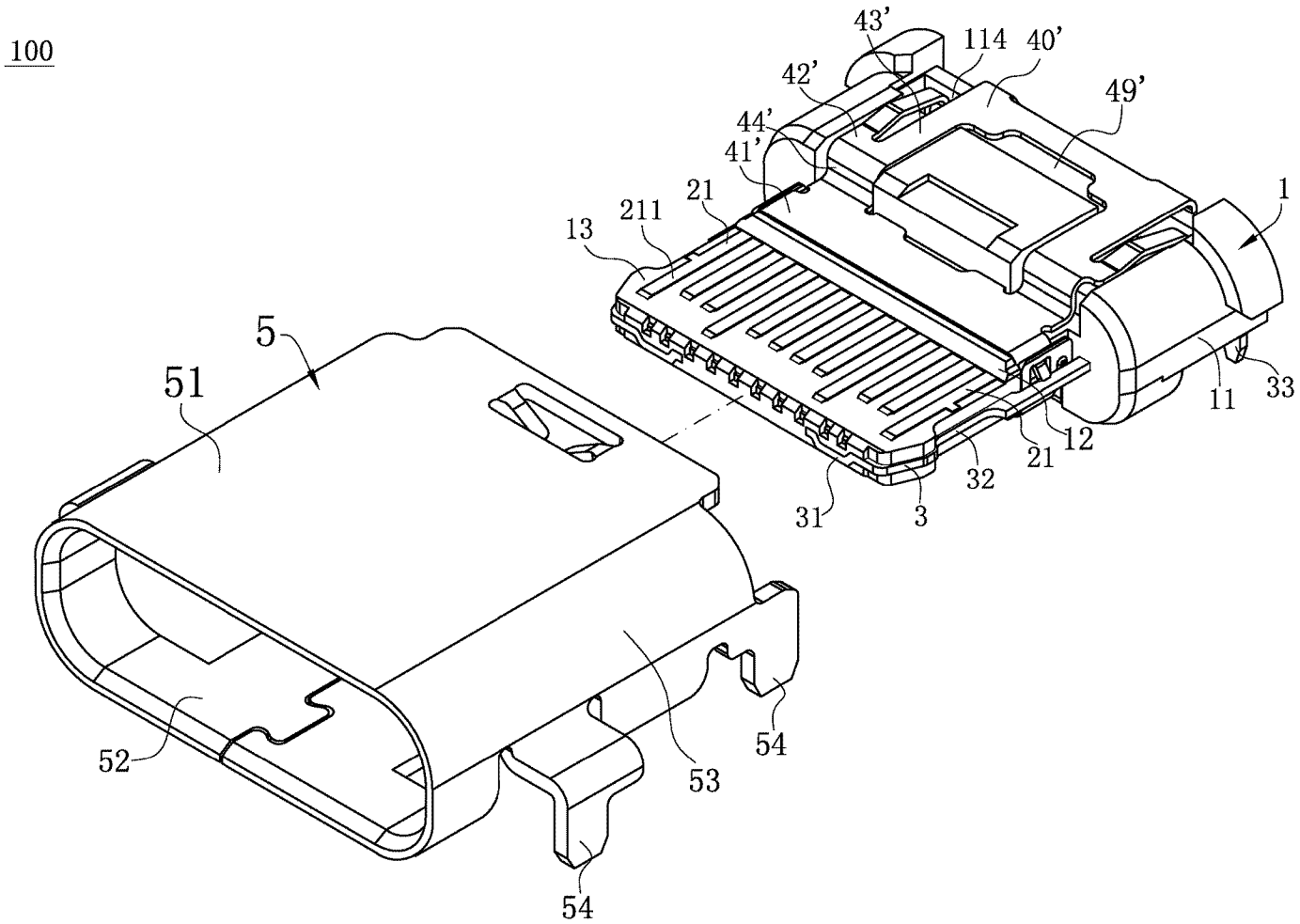
FIG. 2 is a partial three-dimensional explosive view of an electrical connector according to the present invention.

As shown in FIGS. 1 and 2, the terminals 2 include at least one ground terminal 21. In this embodiment, there are four ground terminals 21 respectively located in the upper row and the lower row, and the two terminals 2 at the outermost sides of the terminals 2 in the upper row are both the ground terminals 21. In other embodiments, there may be one or more ground terminals 21, as long as it is ensured that the ground terminal(s) 21 can be in contact with the metal member 4. In this embodiment, each row has 12 terminals 2, and the 12 terminals 2 located in the upper row and the 12 terminals 2 located in the lower row are in a left-and-right opposite arrangement order and in an up-and-down symmetrical arrangement mode, for transmitting the same type of signals. The multiple terminals 2 sequentially arranged in the upper row from left to right are a ground terminal (GND) 21, a high-speed transmitting differential signal terminal pair (TX1+, TX1−, namely USB3.0 terminal), a power terminal (Vbus), a reserved terminal (CC1), a USB2.0 differential terminal pair (Dp1, Dn1), a reserved terminal (SBU1), a power terminal (Vbus), a high-speed receiving differential signal terminal pair (RX2+, RX2−), and a ground terminal (GND) 21. That is, the two terminals 2 located at the outermost sides of the multiple terminals 2 in the upper row are both the ground terminals 21. The multiple terminals 2 sequentially arranged in the lower row from right to left are a ground terminal (GND) 21, a high-speed receiving differential signal terminal pair (TX2+, TX2−, namely USB3.0 terminal), a power terminal (Vbus), a reserved terminal (CC2), a USB2.0 differential terminal pair (Dp2, Dn2), a reserved terminal (SBU2), a power terminal (Vbus), a high-speed receiving differential signal terminal pair (RX1+, RX1−), and a ground terminal (GND) 21. That is, the two terminals 2 at the outermost sides of the multiple terminals 2 located in the lower row are both the ground terminals 21. The multiple terminals 2 located in the upper and lower rows on the insulating body 1 are arranged in such a way that the electrical connector 100 can implement a function of being plugged in dual orientation.

As shown in FIGS. 1-3, each of the terminals 2 is fixed in the base 11, and a portion near the front of each terminal 2 has a contacting arm 211 exposed to the upper and lower surfaces of the tongue 13 for guiding and connecting with a mating connector (not shown). Each terminal 2 includes a connecting portion 212, horizontally extending backward from the contacting arm 211, fixed at the rear end of the tongue 13, and extending to the base 11. Each terminal 2 further includes a soldering arm 213 bending and extending downward from the connecting portion 212, and a soldering portion 214 extends from the tail end of each soldering arm 213, extends out of the escaping slot 115, and is used for being soldered to the circuit board 6. In this embodiment, a surface mount soldering (SMT) form is adopted for soldering. However, a soldering form is not limited thereto, and a DIP form also may be adopted for soldering. The soldering portion 214 of each ground terminal 21 is soldered to a ground path on the circuit board 6.

The shielding sheet 3 is formed by punching a sheet metal, and includes a plate portion 31 provided on the tongue 13 and located between the contacting arms 211 and the connecting portions 212 of the terminals 2 in the upper row and the lower row. Two side edges of the plate portion 31 are recessed separately to form a clamping slot 32 used for clamping the mating connector (not shown). The two sides of the rear end of the plate portion 31 are respectively provided with a fixing pin 33. The fixing pins 33 extend backward from the rear end of the plate portion 31 and then bend and extend downward out of the bottom surface of the base 11, respectively. The two fixing pins 33 are soldered to the circuit board 6 to shield an interference signal between the terminals 2 in the upper row and the lower row, so as to enhance the shielding effect of the electrical connector 100.

The metal member 4 is fixed on the step portion 12, and partially extends to the base 11, and the metal member 4 is made of metal.

As shown in FIGS. 3, 4, 6 and 7, in this embodiment, the metal member 4 includes a first metal member 40 and a second metal member 40'. The second metal member 40' is located at the upper side of the insulating body 1, the first metal member 40 is located at the lower side of the insulating body 1, and the terminals 2 in the upper and lower rows are located between the first metal member 40 and the second metal member 40', i.e., the second metal member 40' is located at the upper side of the terminals 2 in the upper row, while the first metal member 40 is located at the lower side of the terminals 2 in the lower row. The first metal member 40 and the second metal member 40' are fastened together, and are connected and conducted with the shielding sheet 3. The second metal member 40' has a first section 41' located on the tongue 13, and a second section 42' located on the base 11. The second section 42' includes a vertical section 44' connected with the first section 41', a horizontal section 43' formed by extending backward from the vertical section 44', and a second rear cover 47' formed by extending downward from the horizontal section 43'. The second rear cover 47' covers the rear end surface of the base 11, such that the shielding effect of the metal member 4 is better. Moreover, it is unnecessary to additionally provide a rear cover on the metal shell 5, thus greatly simplifying the forming process of the metal shell 5. The vertical section 44' is clamped in the third grooves 113, the horizontal section 43' is clamped in the second grooves 112, and a joint between the vertical section 44' and the horizontal section 43' is located on the second slopes 116 of the second grooves 112 and the third grooves 113.

Figure 4:
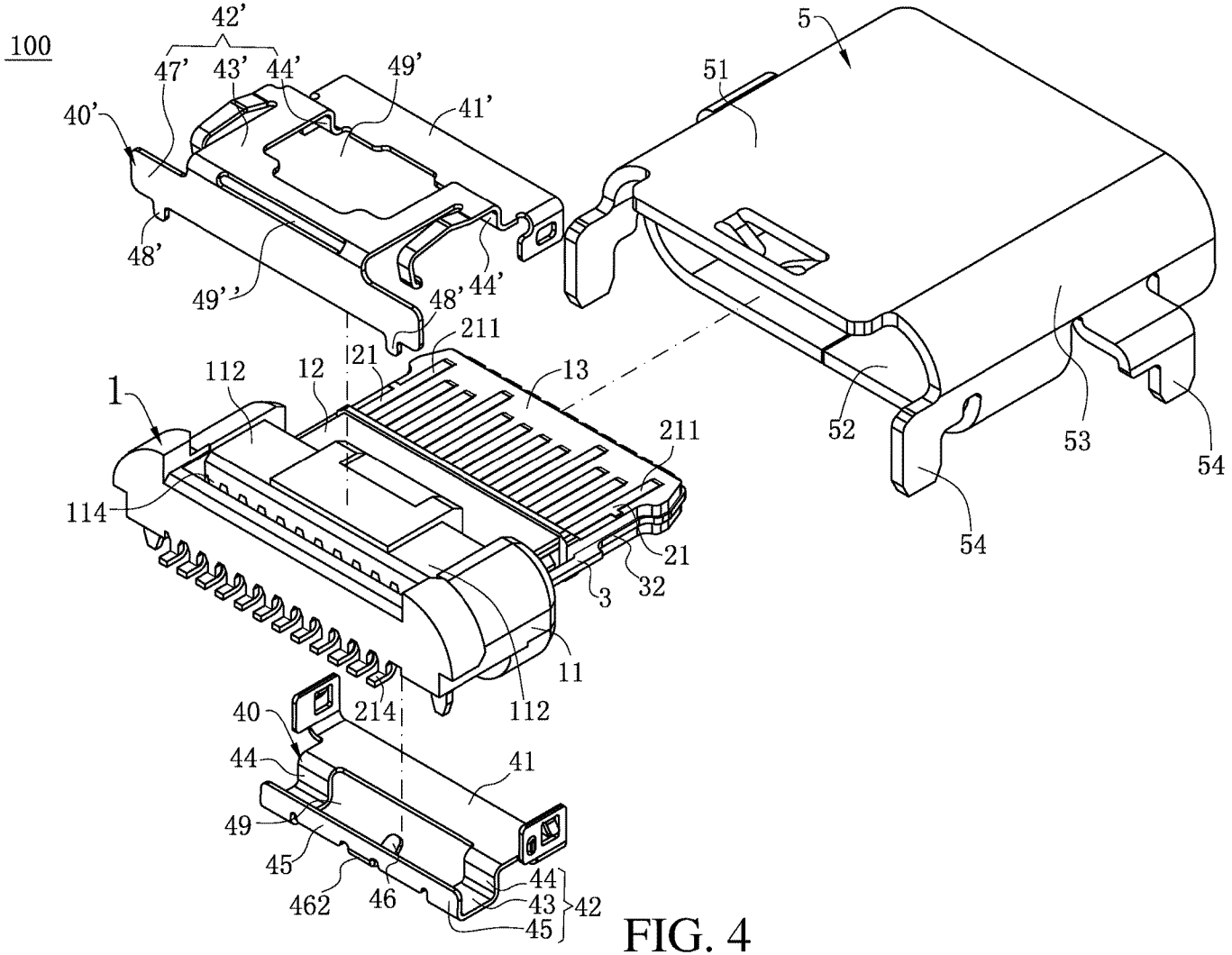
FIG. 4 is a partial three-dimensional exploded view of FIG. 1 from another angle.

As shown in FIGS. 1 and 4, the two sides of the lower end of the second rear cover 47' extend downward vertically to form two soldering pins 48', and the soldering pins 48' and the two ground terminals 21 at the outermost sides of the upper row are soldered on the same soldering pad of the circuit board 6 at the same time, thus simplifying the design of the circuit board 6. A part between the horizontal section 43' and the vertical section 44' of the second metal member 40' is recessed to form a closed-loop-shaped through hole 49', the through hole 49' running through the upper and lower surfaces of the horizontal section 43' and the front and rear surfaces of the vertical section 44'. The rear end of the horizontal section 43' of the second metal member 40' is recessed in the fourth groove 114. A joint between the horizontal section 43' of the second metal member 40' and the second rear cover 47' is recessed to form a second close-loop-shaped through hole 49", such that the second metal member 40' is easier to form by punching.

The first metal member 40 also has a first section 41 located on the tongue 13, and a second section 42 located on the base 11. The second section 42 includes a vertical section 44 connected with the first section 41, a horizontal section 43 formed by extending backward from the vertical section 44, and a first rear cover 45 formed by extending upward from the horizontal section 43. The first rear cover 45 covers the rear end surface of the base 11, such that the shielding effect of the metal member 4 is better. The vertical section 44 is clamped in the third grooves 113, the horizontal section 43 is clamped in the second grooves 112, and a joint between the vertical section 44 and the horizontal section 43 is located on the second slopes 116 of the second grooves 112 and the third grooves 113. A part between the horizontal section 43 and the vertical section 44 of the first metal member 40 is recessed to form a third closed-loop-shaped through hole 49, the through hole 49 running through the upper and lower surfaces of the horizontal section 43 and the front and rear surfaces of the vertical section 44, thus making it easy to form the first metal member 40 by punching.

As shown in FIGS. 6-9, the middle of the lower end of the first rear cover 45 extends forward to form an elastic piece 46, the elastic piece 46 is accommodated in the first groove 111, and the elastic piece 46 urges against the metal shell 5. The width of the elastic piece 46 is gradually narrowed in an extending direction. In this embodiment, preferably, the elastic piece 46 urges against the bottom wall 52 of the metal shell 5. The elastic piece 46 has a contacting portion 461 urging against the metal shell 5. The bottom surfaces of the protruding blocks 117 on the bottom surface of the base 11 are higher than the contacting portion 461, thus, the elastic piece 46 may elastically urge against the metal shell 5 to make the contact more stable, thereby enabling the shielding effect to be better. Moreover, the protruding blocks 117 can avoid over-large interference caused by over-large contact between the bottom surface of the base 11 and the wall surface of the metal shell 5. The lower end of the first rear cover 45 firstly bends and extends forward to form a first bending portion 462, and then bends and extends upward to form a second bending portion 463, the contacting portion 461 being located on the second bending portion 463. The horizontal section 43 of the first metal member 40 is higher than the bottom surfaces of the protruding blocks 117 on the bottom surface of the base 11. After the metal shell 5 is assembled, a certain clearance is provided between the horizontal section 43 and the bottom wall 52 of the metal shell 5 to present touch interference between the horizontal section 43 and the bottom wall 52 of the metal shell 5, thereby preventing the metal member 4 from being deformed by warping or being released. A certain clearance is provided between the free tail end of the elastic piece 46 and the top surface of the first groove 111, such that the elastic piece 46 can freely and elastically move up and down. When the metal shell 5 is not assembled, the elastic piece 46 is in a free state, and the contacting portion 461 of the elastic piece 46 is lower than the bottom surfaces of the protruding blocks 117 on the bottom surface of the base 11. When the metal shell 5 is assembled, the metal shell 5 and the elastic piece 46 undergo touch interference, such that the elastic piece 46 elastically moves upward so as to stably and elastically urge against the metal shell 5. In this embodiment, the elastic piece 46 urges against the bottom wall 52 of the metal shell 5. In other embodiments, the elastic piece 46 may also be provided on the second metal member 40', and the elastic piece 46 urges against the top wall 51 of the metal shell 5. The technical effect is identical to that of the elastic piece 46 on the first metal member 40. Descriptions are not repeated herein any longer.

In summary, the electrical connector 100 according to certain embodiments of the present invention has the following beneficial advantages:

(1) the second section 42, located on the base 11, of the metal member 4 extends forward to form the elastic piece 46 urging against the metal shell 5; and when the metal shell 5 is assembled, an arm of force of the elastic piece 46 is not on the first section 41, located on the tongue 13, of the metal member 4, the elastic piece 46 and the metal shell 5 undergo stress interference so as not to pull the first section 41, and therefore the metal member 4 can be prevented from being released.

(2) The metal member 4 includes a rear cover covering the rear end surface of the base 11, and it is unnecessary to additionally provide a rear cover on the metal shell 5, thus simplifying the forming process of the metal shell 5.

(3) A soldering pin 48' extends from the metal member 4, and is soldered with the ground terminal 21 on the same soldering pad, thus simplifying the design of the circuit board 6.

(4) A protruding block 117 extends downward from the bottom surface of the base 11, and the bottom surface of the protruding block 117 is higher than the contacting portion 461 of the elastic piece 46, such that the elastic piece 46 can elastically urge against the bottom wall 52 of the metal shell 5, and the protruding block 117 can avoid over-large interference caused by over-large contact between the bottom surface of the base 11 and the wall surface of the bottom wall 52 of the metal shell 5. The bottom surface of the protruding block 117 is lower than the second section 42 located on the bottom surface of the base 11, thus avoiding warping or releasing of the metal member 4 caused by contact interference between the second section 42 of the metal member 4 and the bottom wall 52 of the metal shell 5.

(5) A certain clearance is provided between the free end of the elastic piece 46 and the top surface of the first groove 111, accommodating the elastic piece 46, of the base 11, such that the elastic piece 46 can freely and elastically move up and down.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, comprising a base and a tongue extending forward from the base, a rear end of the tongue being provided with a step portion;

a plurality of terminals, fixed in the base, exposed to upper and lower surfaces of the tongue, and arranged in an upper row and a lower row;

a shielding sheet, disposed in the tongue and located between the upper and lower rows of terminals;

a metal member, fixed on the step portion, wherein the metal member has a first section located on the step portion and a second section located on the base, and the second section extends forward to form an elastic piece; and a metal shell, wrapping a periphery of the insulating body and the metal member, the elastic piece urging against the metal shell, wherein the second section comprises a vertical section connected with the first section, a horizontal section extending backward from the vertical section, and a first rear cover bending and extending upward from the horizontal section, the first rear cover covers a rear end surface of the base.

2. The electrical connector of claim 1, wherein the elastic piece firstly bends and extends forward from a lower end of the first rear cover to form a first bending portion, and then bends and extends upward to form a second bending portion, the elastic piece has a contacting portion urging against the metal shell, and the contacting portion is located on the second bending portion.

3. The electrical connector of claim 2, wherein a bottom surface of the base extends downward to form a protruding block, a front end surface of the protruding block is provided with a first slope, and a bottom surface of the protruding block is higher than the contacting portion.

4. The electrical connector of claim 3, wherein the bottom surface of the protruding block is lower than the horizontal section.

5. The electrical connector of claim 1, wherein a bottom surface of the base is recessed upward to form a first groove, the elastic piece is accommodated in the first groove, and a clearance is provided between a free tail end of the elastic piece and a top surface of the first groove.

6. The electrical connector of claim 1, wherein two outermost of the terminals in the upper row are two ground terminals, each of the two ground terminals is provided with a soldering portion, a soldering pin extends from a rear end of the metal member, the soldering pin is adjacent to the soldering portion of the corresponding one of the two ground terminals, and the soldering pin and the corresponding one of the two ground terminals are soldered on a same soldering pad on a circuit board.

7. The electrical connector of claim 6, wherein a rear end of the second section bends and extends downward to form a second rear cover, the second rear cover covers a rear end surface of the base, and the soldering pin is formed by extending downward from the lower end of the second rear cover.

8. An electrical connector, comprising:

an insulating body, comprising a base and a tongue extending forward from the base;

a plurality of terminals, fixed in the base and exposed to a surface of the tongue;

a metal member, fixed on the tongue, wherein the metal member has a first section located on the tongue and a second section located on the base, and the second section extends forward to form an elastic piece; and a metal shell, wrapping a periphery of the insulating body and the metal member, the elastic piece urging against the metal shell, wherein the second section comprises a vertical section connected with the first section, a horizontal section extending backward from the vertical section, and a first rear cover bending and extending upward from the horizontal section, the first rear cover covers a rear end surface of the base.

9. The electrical connector of claim 8, wherein a bottom surface of the base is recessed upward to form a first groove, the elastic piece is accommodated in the first groove, and a clearance is provided between a free tail end of the elastic piece and a top surface of the first groove.

10. The electrical connector of claim 8, wherein a bottom surface of the base is recessed upward to form a second groove, a front end surface of the base is recessed backward to form a third groove, the horizontal section is clamped in the second groove, the vertical section is clamped in the third groove, the second groove is communicated with the third groove, and a second slope is provided at a joint between the second groove and the third groove.

11. The electrical connector of claim 8, wherein the elastic piece firstly bends and extends forward from a lower end of the first rear cover to form a first bending portion, and then bends and extends upward to form a second bending portion, the elastic piece has a contacting portion urging against the metal shell, and the contacting portion is located on the second bending portion.

12. The electrical connector of claim 11, wherein a bottom surface of the base extends downward to form a protruding block, and a bottom surface of the protruding block is higher than the contacting portion.

13. The electrical connector of claim 12, wherein the bottom surface of the protruding block is lower than the horizontal section.

14. The electrical connector of claim 8, wherein the second section is recessed to form at least one closed-loop-shaped through hole, the through hole running through upper and lower surfaces of the second section.

15. The electrical connector of claim 8, wherein the terminals comprise at least one ground terminal, the at least ground terminal has a soldering portion, a soldering pin extends from a rear end of the metal member, the soldering pin is adjacent to the soldering portion, and the soldering pin and the soldering portion are soldered on a same soldering pad on a circuit board.

16. The electrical connector of claim 15, wherein a rear end of the second section bends and extends downward to form a second rear cover, the second rear cover covers a rear end surface of the base, and the soldering pin is formed by extending downward from the lower end of the second rear cover.

17. An electrical connector, comprising:

an insulating body, comprising a base and a tongue extending forward from the base, a rear end of the tongue being provided with a step portion;

a plurality of terminals, fixed in the base, exposed to upper and lower surfaces of the tongue, and arranged in an upper row and a lower row;

a shielding sheet, disposed in the tongue and located between the upper and lower rows of terminals;

a metal member, fixed on the step portion, wherein the metal member has a first section located on the step portion and a second section located on the base, and the second section extends forward to form an elastic piece; and a metal shell, wrapping a periphery of the insulating body and the metal member, the elastic piece urging against the metal shell, wherein a bottom surface of the base is recessed upward to form a first groove, the elastic piece is accommodated in the first groove, and a clearance is provided between a free tail end of the elastic piece and a top surface of the first groove.

18. The electrical connector of claim 17, wherein two outermost of the terminals in the upper row are two ground terminals, each of the two ground terminals is provided with a soldering portion, a soldering pin extends from a rear end of the metal member, the soldering pin is adjacent to the soldering portion of the corresponding one of the two ground terminals, and the soldering pin and the corresponding one of the two ground terminals are soldered on a same soldering pad on a circuit board.

19. The electrical connector of claim 18, wherein a rear end of the second section bends and extends downward to form a second rear cover, the second rear cover covers a rear end surface of the base, and the soldering pin is formed by extending downward from the lower end of the second rear cover.

20. An electrical connector, comprising:

an insulating body, comprising a base and a tongue extending forward from the base, a rear end of the tongue being provided with a step portion;

a plurality of terminals, fixed in the base, exposed to upper and lower surfaces of the tongue, and arranged in an upper row and a lower row;

a shielding sheet, disposed in the tongue and located between the upper and lower rows of terminals;

a metal member, fixed on the step portion, wherein the metal member has a first section located on the step portion and a second section located on the base, and the second section extends forward to form an elastic piece; and a metal shell, wrapping a periphery of the insulating body and the metal member, the elastic piece urging against the metal shell, wherein two outermost of the terminals in the upper row are two ground terminals, each of the two ground terminals is provided with a soldering portion, a soldering pin extends from a rear end of the metal member, the soldering pin is adjacent to the soldering portion of the corresponding one of the two ground terminals, and the soldering pin and the corresponding one of the two ground terminals are soldered on a same soldering pad on a circuit board.

21. The electrical connector of claim 20, wherein a rear end of the second section bends and extends downward to form a second rear cover, the second rear cover covers a rear end surface of the base, and the soldering pin is formed by extending downward from the lower end of the second rear cover.

* * * * *